US008378892B2

(12) United States Patent
Sorvala et al.

(10) Patent No.: US 8,378,892 B2
(45) Date of Patent: Feb. 19, 2013

(54) ANTENNA COMPONENT AND METHODS

(75) Inventors: Juha Sorvala, Oulu (FI); Petteri Annamaa, Oulunsalo (FI); Kimmo Koskiniemi, Oulu (FI)

(73) Assignee: Pulse Finland Oy, Kempele (FI)

( * ) Notice: Subject to any disclaimer, the term of this patent is extended or adjusted under 35 U.S.C. 154(b) by 909 days.

(21) Appl. No.: 11/901,611

(22) Filed: Sep. 17, 2007

(65) Prior Publication Data

US 2008/0088511 A1 Apr. 17, 2008

Related U.S. Application Data

(63) Continuation of application No. PCT/FI2005/050401, filed on Nov. 8, 2005.

(30) Foreign Application Priority Data

Mar. 16, 2005 (WO) ..... PCT/FI2005/050089
Jun. 28, 2005 (WO) ..... PCT/FI2005/050247

(51) Int. Cl.
*H01Q 1/38* (2006.01)

(52) U.S. Cl. ..... 343/700 MS

(58) Field of Classification Search ..... 343/700 MS, 343/702, 833, 907, 908
See application file for complete search history.

(56) References Cited

U.S. PATENT DOCUMENTS

| | | | | |
|---|---|---|---|---|
| 5,764,190 | A | 6/1998 | Murch | |
| 6,002,369 | A * | 12/1999 | Richard | 343/700 MS |
| 6,100,849 | A * | 8/2000 | Tsubaki et al. | 343/702 |
| 6,147,650 | A | 11/2000 | Kawahata | |
| 6,177,908 | B1 * | 1/2001 | Kawahata et al. | 343/700 MS |
| 6,323,811 | B1 | 11/2001 | Tsubaki | |
| 6,421,014 | B1 * | 7/2002 | Sanad | 343/700 MS |
| 6,456,249 | B1 | 9/2002 | Johnson | |
| 6,501,425 | B1 * | 12/2002 | Nagumo et al. | 343/700 MS |
| 6,614,400 | B2 | 9/2003 | Egorov | |
| 6,650,295 | B2 | 11/2003 | Ollikainen | |
| 6,683,573 | B2 | 1/2004 | Park | |
| 6,950,066 | B2 | 9/2005 | Hendler | |
| 7,095,372 | B2 * | 8/2006 | Soler Castany et al. | 343/700 MS |
| 7,126,546 | B2 | 10/2006 | Annamaa | |
| 7,136,019 | B2 | 11/2006 | Mikkola | |
| 7,205,942 | B2 | 4/2007 | Wang | |
| 2002/0019247 | A1 | 2/2002 | Egorov | |
| 2002/0145569 | A1 | 10/2002 | Onaka | |

(Continued)

FOREIGN PATENT DOCUMENTS

| | | |
|---|---|---|
| EP | 0 766 341 | 2/1997 |
| EP | 0 831 547 A2 | 3/1998 |

(Continued)

*Primary Examiner* — Jacob Y Choi
*Assistant Examiner* — Robert Karacsony
(74) *Attorney, Agent, or Firm* — Gazdzinski & Associates, PC

(57) ABSTRACT

An antenna component (200) with a dielectric substrate and two radiating antenna elements. The elements are located on the upper surface of the substrate and there is a narrow slot (260) between them. The antenna feed conductor (241) is connected to the first antenna element (220), which is connected also to the ground by a short-circuit conductor (261). The second antenna element (230) is parasitic; it is galvanically connected only to the ground. The component is preferably manufactured by a semiconductor technique by growing a metal layer e.g. on a quartz substrate and removing a part of it so that the antenna elements remain. In this case the component further comprises supporting material (212) of the substrate chip. The antenna component is very small-sized because of the high dielectricity of the substrate to be used and mostly because the slot between the antenna elements is narrow. The efficiency of an antenna made by the component is high.

24 Claims, 5 Drawing Sheets

U.S. PATENT DOCUMENTS

| | | | | |
|---|---|---|---|---|
| 2002/0162894 | A1 | 11/2002 | Kuramochi | |
| 2002/0163470 | A1 | 11/2002 | Nagumo | |
| 2002/0196192 | A1 | 12/2002 | Nagumo | |
| 2003/0020659 | A1 | 1/2003 | Kushihi | |
| 2003/0222827 | A1 | 12/2003 | Sung | |
| 2004/0080457 | A1 | 4/2004 | Guo | |
| 2004/0090378 | A1 | 5/2004 | Dai | |
| 2004/0090382 | A1 | 5/2004 | Kushihi | |
| 2004/0233109 | A1* | 11/2004 | Ying et al. | 343/700 MS |
| 2005/0024272 | A1 | 2/2005 | Ponce De Leon | |
| 2005/0057401 | A1 | 3/2005 | Yuanzhu | |
| 2005/0057416 | A1 | 3/2005 | Yuanzhu | |
| 2005/0078037 | A1 | 4/2005 | Leclerc | |
| 2005/0078038 | A1* | 4/2005 | Takaki et al. | 343/702 |
| 2005/0128152 | A1* | 6/2005 | Milosavljevic | 343/702 |
| 2005/0243001 | A1 | 11/2005 | Miyata | |
| 2006/0071857 | A1 | 4/2006 | Pelzer | |
| 2006/0145924 | A1 | 7/2006 | Chen | |
| 2007/0139277 | A1 | 6/2007 | Nissinen | |
| 2007/0152881 | A1 | 7/2007 | Chan | |
| 2007/0152885 | A1 | 7/2007 | Sorvala | |
| 2007/0171131 | A1 | 7/2007 | Sorvala | |
| 2007/0268190 | A1 | 11/2007 | Huynh | |
| 2008/0007459 | A1 | 1/2008 | Koskiniemi | |
| 2008/0088511 | A1 | 4/2008 | Sorvala | |
| 2009/0135066 | A1 | 5/2009 | Raappana | |

FOREIGN PATENT DOCUMENTS

| | | | |
|---|---|---|---|
| EP | 0 942 488 | A2 | 9/1999 |
| EP | 1 003 240 | A2 | 5/2000 |
| EP | 1 102 348 | | 5/2001 |
| EP | 1 113 524 | | 7/2001 |
| EP | 1 128 466 | A2 | 8/2001 |
| EP | 1 139 490 | | 10/2001 |
| EP | 1 146 589 | | 10/2001 |
| EP | 1 148 581 | A1 | 10/2001 |
| EP | 1 248 316 | | 9/2002 |
| EP | 1 267 441 | | 12/2002 |
| EP | 1 294 049 | A1 | 3/2003 |
| EP | 1 351 334 | | 8/2003 |
| EP | 1 361 623 | | 11/2003 |
| EP | 1 414 108 | | 4/2004 |
| EP | 1 432 072 | | 6/2004 |
| EP | 1 482592 | | 12/2004 |
| GB | 2 067 842 | A | 7/1981 |
| JP | 10 209733 | | 8/1998 |
| JP | 11 004117 | | 1/1999 |
| JP | 2004112028 | | 4/2004 |
| JP | 2004363859 | | 12/2004 |
| JP | 2005005985 | | 1/2005 |
| KR | 10-2006-7027462 | | 12/2002 |
| WO | WO 00/36700 | | 6/2000 |
| WO | WO 01/28035 | | 4/2001 |
| WO | WO 01/33665 | | 5/2001 |
| WO | WO 02/078123 | | 10/2002 |
| WO | WO 2004/070872 | | 8/2004 |
| WO | WO 2004/112189 | A | 12/2004 |
| WO | WO 2005/018045 | | 2/2005 |
| WO | WO 2005/055364 | | 6/2005 |
| WO | WO 2005/062416 | | 7/2005 |
| WO | WO 2006/000631 | A1 | 1/2006 |
| WO | WO 2006/000650 | | 1/2006 |
| WO | WO 2006/051160 | A1 | 5/2006 |
| WO | WO 2006/084951 | A1 | 8/2006 |
| WO | WO 2006/097567 | | 9/2006 |
| WO | WO 2007/000483 | A1 | 1/2007 |
| WO | WO 2007/009668 | | 4/2007 |
| WO | WO 2007/039667 | | 4/2007 |
| WO | WO 2007/042614 | | 4/2007 |
| WO | WO 2007/042615 | | 4/2007 |
| WO | WO 2007/138157 | | 12/2007 |

* cited by examiner

ANTENNA COMPONENT AND METHODS

PRIORITY AND RELATED APPLICATIONS

This is a continuation application of and claims priority to International PCT Application No. PCT/FI2005/050401 having an international filing date of Nov. 8, 2005, which claims priority to PCT/FI2005/050247 having an international filing date of Jun. 28, 2005, and International PCT Application No. PCT/FI2005/050089 having an international filing date of Mar. 16, 2005, each of the foregoing incorporated herein by reference in its entirety. This application is related to co-owned and co-pending U.S. patent application Ser. No. 11/883,945 filed Aug. 6, 2007 entitled "Internal Monopole Antenna and Methods"; Ser. No. 11/801,894 filed May 11, 2007 and entitled "Antenna component and methods"; Ser. No. 11/544,173 filed Oct. 5, 2006 and entitled "Multi-Band Antenna With a Common Resonant Feed Structure and Methods"; Ser. No. 11/603,511 filed Nov. 22, 2006 and entitled "Multiband Antenna Apparatus and Methods"; Ser. No. 11/648,429 filed Dec. 28, 2006 and entitled "Antenna, Component And Methods", and Ser. No. 11/648,431 also filed Dec. 28, 2006 and entitled "Chip Antenna Apparatus and Methods", each of which are incorporated herein by reference in their entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

The invention relates to a component, where conductive coatings of a dielectric substrate function as radiators of an antenna. The invention also relates to an antenna made by such a component.

BACKGROUND OF THE INVENTION

In small-sized radio devices, such as mobile phones, the antenna or antennas are preferably placed inside the cover of the device, and naturally the intention is to make them as small as possible. An internal antenna has usually a planar structure so that it includes a radiating plane and a ground plane below it. There is also a variation of the monopole antenna, in which the ground plane is not below the radiating plane but farther on the side. In both cases, the size of the antenna can be reduced by manufacturing the radiating plane on the surface of a dielectric chip instead of making it air insulated. The higher the permittivity of the material, the smaller the physical size of an antenna element of a certain electric size. The antenna component becomes a chip to be mounted on a circuit board. However, such a reduction of the size of the antenna entails the increase of losses and thus a deterioration of efficiency.

FIG. 1 shows an antenna component and a whole antenna according to application FI 20040892, known by the applicant. The antenna component 100 comprises an elongated and rectangular dielectric substrate 110 and two antenna elements on its surface. The first antenna element 120 comprises a portion 121 partly covering the upper surface of the substrate 110 and a head portion 122 covering one head of the substrate. The second antenna element 130 comprises symmetrically a portion 131 covering the upper surface of the substrate partly and a head portion 132 covering the opposite head. Each head portion 122 and 132 continues slightly on the side of the lower surface of the substrate, thus forming the contact surface of the element for its connection. In the middle of the upper surface between the elements there remains a slot 160, over which the elements have an electromagnetic coupling with each other. The slot 160 extends in the transverse direction perpendicularly from one lateral surface of the substrate to the other. The antenna component 100 is located on the circuit board PCB of a radio device its lower surface against the circuit board. The antenna feed conductor 140 is a strip conductor on the upper surface of the circuit board, and together with the ground plane, or the signal ground GND, and the circuit board material it forms a feed line having a certain impedance. The feed conductor 140 is galvanically coupled to the first antenna element 120 at a certain point of its contact surface. At another point of that contact surface, the first antenna element is galvanically coupled to the ground plane GND. At the opposite end of the substrate, the second antenna element 130 is galvanically coupled at its contact surface to the ground conductor 150, which is an extension of the wider ground plane GND.

At the operating frequency, both antenna elements together with the substrate, each other and the ground plane form a quarter-wave resonator. In compliance with the above described structure, the open ends of the resonators are facing each other, separated by the slot 160, and the electromagnetic coupling is clearly capacitive. The width d of the slot can be dimensioned so that the dielectric losses of the substrate are minimized. The optimum width is in that case e.g. 1.2 mm and a suitable range of variation 0.8-2.0 mm, for example. When a ceramic substrate is used, the structure provides a relatively small size. For example, the dimensions of a component of a Bluetooth antenna operating in the frequency range of 2.4 GHz can be $2\times2\times7$ $mm^3$.

The antenna is tuned by shaping the ground plane and by choosing the width of the slot between the antenna elements. The decreasing the width d of the slot lowers the natural frequency of the antenna. There is no ground plane under the antenna component 100, and on the side of the component the ground plane is at a certain distance s from it. The longer the distance, the lower the natural frequency. In turn, increasing the width d of the slot. The width and length of the ground conductor 150 affect directly the electric length of the second element and thus the natural frequency of the whole antenna, for which reason the ground conductor functions as a tuning element of the antenna. The distance s has an effect also on the antenna impedance, so that the antenna can be matched by finding the optimum distance of the ground plane from the long side of the antenna component.

SUMMARY OF THE INVENTION

The object of the invention is to implement an antenna component by a new and advantageous way in view of the prior art. An antenna component according to the invention is characterized in what is set forth in the independent claim 1. An antenna according to the invention is characterized in what is set forth in the independent claim 16. Some preferred embodiments of the invention are set forth in the other claims.

The basic idea of the invention is the following: The antenna component comprises a dielectric substrate and two radiating antenna elements. The elements are located on the upper surface of the substrate and there is a narrow slot between them. The antenna feed conductor is connected to the first antenna element, which is connected also to the ground by a short-circuit conductor. The second antenna element is parasitic; it is galvanically connected only to the ground. The component is preferably manufactured by a semiconductor technique by growing a metal layer e.g. on a quartz substrate and removing a part of it so that the antenna elements remain. In this case the component further comprises supporting material of the substrate chip.

The invention has the advantage that an antenna component according to it is very small-sized. This is due to that the slot between the antenna elements is narrow and that the high permittivity of the substrate to be used. In addition, the invention has the advantage that the efficiency of an antenna made by a component according to it is good in spite of the dielectric substrate. A further advantage of the invention is that both the tuning and the matching of an antenna can be carried out without discrete components just by shaping the conductor pattern of the circuit board near the antenna component.

In another aspect of the invention, a device for use in an antenna apparatus is disclosed. In one embodiment, the device comprises: a dielectric substrate; a first conductive element positioned on the upper surface of the dielectric substrate; a second conductive element positioned on the upper surface of the dielectric substrate such that the second conductive element is separated from the first conductive element by a region; and at least one electrical contact point disposed on each of the first and second conductive elements.

In one variant, the region comprises a width of 0.5 mm or less.

In another variant, the dielectric substrate comprises a material selected from the group consisting of quartz, gallium-arsenide, and silicon.

In yet another variant, the area of the dielectric substrate is between 2 and 3 $mm^2$, and the dielectric substrate comprises a thickness of 100 μm.

In a further variant, at least one of the first conductive element and the second conductive element comprise gold.

In still a further variant, at least one of the first conductive element and the second conductive element comprise a thickness of 2 μm.

In another variant, the dielectric substrate is adapted to be attached to a dielectric support plate.

In yet another variant, the dielectric support plate comprises a thickness of 0.3 mm.

In still another variant, the first conductive element and the second conductive element each comprise the shape of a right-angled triangle, wherein the region separates the hypotenuse of the first conductive element from the hypotenuse of the second conductive element.

In a further variant, the region separates the first conductive element from the second conductive element by a rectangular alternating pattern.

In still a further variant, the first conductive element comprises an area smaller than the area of the second conductive element.

In another variant, the device is adapted to be electrically coupled to a circuit board through the at least one electrical contact point.

In yet another variant, the circuit board comprises a feed conductor adapted to electrically couple the circuit board with the at least one electrical contact point.

In a further variant, the circuit board comprises a ground conductor, the ground conductor comprising an adjustable dimension adapted for tuning an antenna.

In another aspect of the invention, a circuit board is disclosed. In one embodiment, the circuit board comprises: a strip conductor adapted to be electrically coupled to a first electrical contact point positioned on the upper surface of an antenna component; a signal ground adapted to be electrically coupled to a second electrical contact point positioned on the upper surface of the antenna component; and a ground conductor adapted to be electrically coupled to a third electrical contact point positioned on the upper surface of the antenna component, the ground conductor comprising at least one adjustable dimension for tuning an antenna.

In one variant, the signal ground comprises the ground conductor.

In another variant, the at least one adjustable dimension comprises an adjustable length.

In yet another variant, the at least one adjustable dimension comprises an adjustable width.

In still another variant, the board further comprises a first region for situating the antenna component, wherein one side of the first region is separated from the ground plane of the circuit board by an empty region.

In another aspect of the invention, antenna apparatus is disclosed. In one embodiment, the apparatus comprises: a device comprising a first antenna element and a second antenna element, the first element and the second element disposed on the upper surface of a dielectric substrate, wherein a region separates the first antenna element from the second antenna element; an antenna filter electrically coupled to the first antenna element; and a low-noise amplifier electrically coupled to the antenna filter.

In one variant of the antenna apparatus, the region comprises a width of not more than 0.5 mm, and the antenna filter comprises a film bulk acoustic resonator.

In another variant, the antenna filter is electrically coupled to the first antenna element by electrical wiring.

In yet another variant, the antenna filter is electrically coupled to the first antenna element by conductors situated on the surface of the dielectric substrate.

In still a further aspect of the invention, a method of operating an antenna is disclosed. In one embodiment, the method comprises: receiving a signal at an active antenna comprising a first conductive element; and re-radiating at least a portion of the signal at a parasitic element The parasitic element comprises a second conductive element, and the second conductive element is separated from the first conductive element by a region comprising a width of 0.5 mm or less.

In yet another aspect of the invention, an antenna component for implementing an antenna of a radio device is disclosed. In one embodiment, the component comprises a dielectric substrate and a first and a second antenna element on the substrate surface, which first antenna element is to be fed by a feed conductor and to be short-circuited, and which second antenna element is a parasitic element to be short-circuited, getting its feed electromagnetically over a slot between the elements. The first and second antenna elements are conductive areas on upper surface of the substrate, the feed conductor connects the first antenna element from its feed point to a contact pad at a level below the substrate, short-circuit of the first antenna element is implemented by a first short-circuit conductor, which connects the first antenna element from its short-circuit point to a second contact pad at the level below the substrate, short-circuit of the second antenna element is implemented by a second short-circuit conductor, which connects the second antenna element from its short-circuit point to a third contact pad at the level below the substrate, and the width of the slot is at most 0.5 mm.

In one variant. The component further comprise a dielectric support plate, on upper surface of which the substrate with antenna elements is attached and the contact pads are located.

In another variant, the feed and short-circuit conductors being conductive wires fastened by bonded joints.

In yet another variant, the substrate comprises a basic material used in a semiconductor technique, and the antenna elements and the slot between them being formed by such a semiconductor technique.

In a further variant, the basic material being quartz, gallium-arsenide or silicon.

In another variant, the feed and short-circuit conductors comprise conductive vias of the substrate, the contact pads being located on lower surface of the substrate and making, after mounting of the component, contact with counter contacts on the circuit board. The dielectric substrate may be e.g., a ceramic material.

In still another variant, the component further comprises a third short-circuit conductor, which connects the second antenna element from its second short-circuit point to a fourth contact pad at the level below the substrate.

In another variant, the component further comprises a plastic protective and support part, within mass of which the substrate and the antenna elements are entirely located, and the contact pads are located on lower surface of the protective and support part.

In still another variant, the slot is straight and travels crosswise on the upper surface of the substrate in the direction of its ends.

In a further variant, the slot is straight and travels diagonally on the upper surface of the substrate in respect of the direction of its ends.

In another variant, the slot has at least two turns.

In still another variant, the turns of the slot form in one antenna element at least one finger-like extension, which extends between the areas belonging to the opposite antenna element.

In yet a further variant, the antenna elements are asymmetric in shape.

In another variant, both the first and second antenna element form at an operating frequency together with the substrate, the opposite antenna element and the ground plane a quarter-wave resonator, which resonators have a substantially same natural frequency.

In another aspect of the invention, an antenna of a radio device is disclosed. In one embodiment, the radio device comprises a circuit board, a conductive coating of which functions as a ground plane of the radio device, the antenna comprising at least one antenna component. The component is located on the circuit board with its lower surface against the circuit board, wherein the edge of the ground plane is at a certain distance from the elements of the antenna component in the direction of the normal of the side of the component to tune the antenna and to improve its matching.

In one variant, the second antenna element is connected to the ground plane through a ground conductor, which is a tuning element of the antenna at the same time.

In another variant, the antenna component is arranged to excite in the ground plane an oscillation with feed frequency, to utilize a radiation of the ground plane.

BRIEF DESCRIPTION OF THE DRAWINGS

In the following, the invention will be described in more detail. Reference will be made to the accompanying drawings, in which.

DETAILED DESCRIPTION OF THE INVENTION

Figure 1:
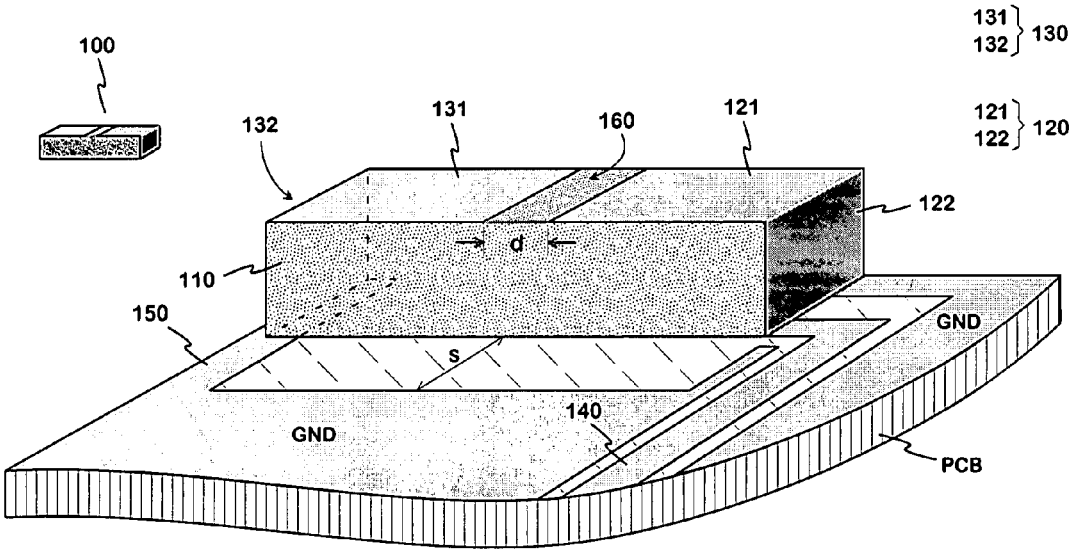
Fig. 1 PRIOR ART
FIG. 1 presents an example of a prior art antenna component and antenna.

FIG. 1 was already explained in connection with the description of the prior art.

Figure 2:
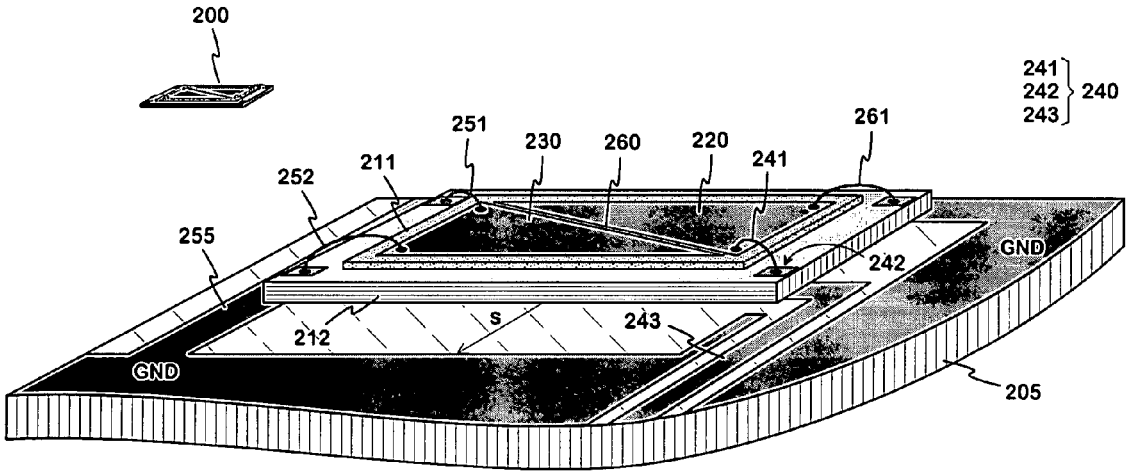
FIG. 2 presents an example of an antenna component and antenna according to the invention.

FIG. 2 shows an example of an antenna component and an whole antenna according to the invention. A part of the circuit board 205 of a radio device and an antenna component 200 on its surface are seen enlarged in the drawing. The antenna component 200 comprises a dielectric substrate 211 and two antenna elements on its surface, one of which has been connected to the antenna feed conductor and the other is an electromagnetically fed parasitic element, like in the antenna component 100 in FIG. 1. The difference is that the antenna elements now are located totally on the upper surface of the substrate, where their connection points then also are located. In the component of FIG. 1 the elements extend via the head surfaces to the lower surface of the substrate, where their connection points then also are, located. In addition, in the component according to the invention the slot 260 between the elements is considerably narrower than in the component of FIG. 1 and also generally in the next corresponding known antennas, so that the coupling between the elements is stronger.

In the example of FIG. 2 the substrate 211 is a thin chip with the thickness e.g. order of 100 μm. In this case its material is some basic material used in the semiconductor technique, such as quartz, gallium-arsenide or silicon. The antenna elements are preferably of gold, and their thickness is naturally even far smaller, for example 2 μm. The elements are formed by growing a metal layer on the surface of the substrate e.g. by the sputtering technique and removing the layer, among other things, at the place of the intended slot by the exposure and etching technique used in the manufacture of semiconductor components. This makes it possible to fabricate a slot having even 10 μm width. A very small component size can be achieved by means of the structure according to the invention, when using the semiconductor technique. The area of the substrate chip at the operating frequencies over 2 GHz is e.g. 2-3 $mm^2$. The slot width order of magnitude 50 μm or less and the dielectric substrate together result in that the electric size of the antenna elements is for example tenfold compared with the physical size.

The substrate chip needs mechanical support, for which reason it has been attached on the upper surface of a dielectric support plate 212 belonging to the antenna component. The material of the support plate is stronger than the one of the substrate, and its thickness is e.g. 0.3 mm. The support plate again has been attached to the circuit board 205.

The antenna elements have in the example of FIG. 2 a shape of right-angled triangle so that the slot 260 between them travels diagonally from close a corner of the substrate close to the opposite farthest corner. The first antenna element 220 is the directly fed element and the second antenna element 230 is a parasitic element. The first antenna element is connected by the feed conductor 241 to a contact pad on the upper surface of the support plate 212 from the feed point, which is located at one end of the element side near the first end of the substrate. From the contact pad there is a via 242 to the circuit board 205, the lower end of which via is connected on the circuit board to a strip conductor 243 leading to the antenna port of the radio device. The whole feed conductor 240 of the exemplary antenna is then constituted from the strip conductor 243, via 242 and feed conductor 241. In addition, the first antenna element is connected by a short-circuit conductor 261 to a second contact pad on the upper surface of the support plate 212 from a short-circuit point, which is located at other, opposite end of the element side near the first end of the substrate. From this contact pad there is a via to the signal ground GND on the circuit board 205. The second antenna element 230 is connected by the second 251 and third 252 short-circuit conductors to the third and fourth contact pads on the upper surface of the support plate 212 from a short-circuit points, which are located at opposite ends of the element side near the second end of the substrate. From these contact pads there are vias to a ground conductor 255 on the circuit board 205. The feed conductor 241 and said three short-circuit conductors belong to the antenna component 200. They are most advantageously conductive wires made of gold and fastened by bonded joint at their ends.

Each antenna element forms with the substrate, ground and the other element a quarter wave resonator. The natural frequencies of these resonators are same or close to each other so that the antenna is one-band antenna.

The ground conductor 255 is an extension of the larger signal ground or ground plane GND, and it can be used for the tuning of the antenna by choosing its length and width suitably. The antenna tuning is affected by the shaping also other parts of the ground plane. There is no ground plane under the antenna component 200, and on the side of the component the ground plane is at a certain distance s from the antenna element. The longer the distance, the lower the natural frequency and location of the antenna operating band. In addition, the antenna matching can be improved by means of the area free of the ground plane. When the antenna component is placed in the inner area of the circuit board, the ground plane is removed from its both sides.

Figure 3:
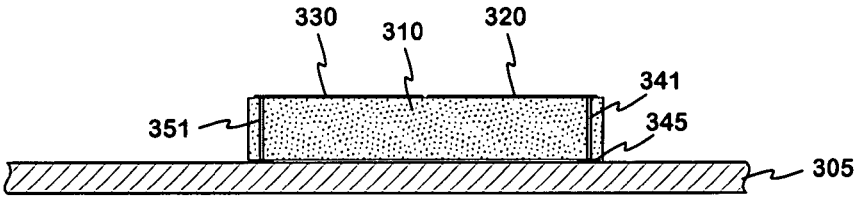
FIG. 3 presents another example of an antenna component according to the invention.

FIG. 3 shows another example of an antenna component according to the invention as a longitudinal section. The component comprises a ceramic substrate 310, on the upper surface of which there are the first 320 and second 330 antenna element. The feed conductor 341 belonging to the component is in this example a conductive via extending through the substrate from the first antenna element to a contact pad 345 on the lower surface of the substrate. The antenna component has been mounted on the circuit board 305 of a radio device, in which case the contact pad 345 makes contact with the counter contact on the circuit board and is through that contact further connected to the antenna port of the device. Also the short-circuit conductor of the first antenna element, which conductor is not seen in the drawing, and the short-circuit conductor 351 of the second antenna element 330 are implemented by the similar vias. The second antenna element can have also another short-circuit conductor.

Figure 4A:
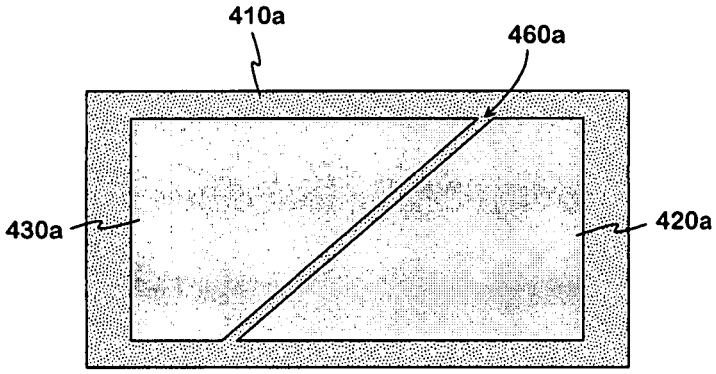
FIGS. 4*a-c* present examples of a shaping the slot between the antenna elements in the antenna component according to the invention.
Figure 4B:
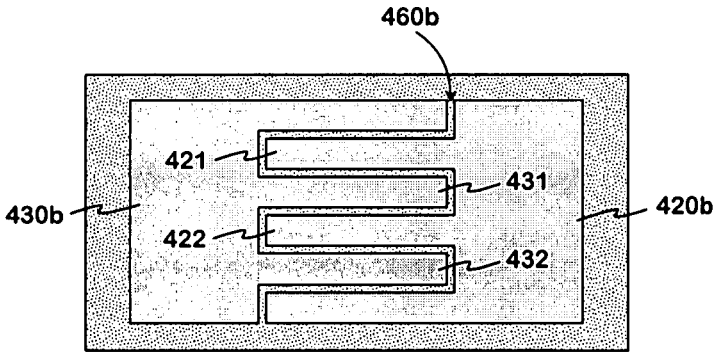
Figure 4C:
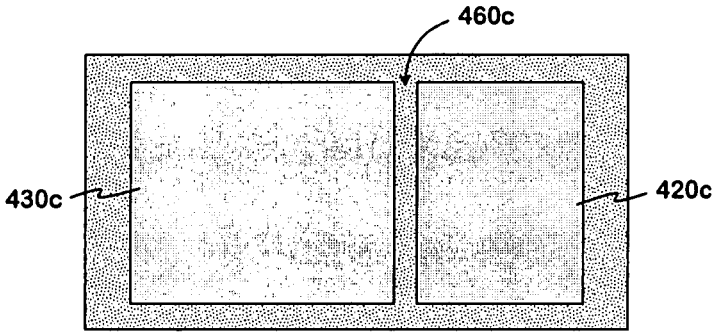

FIGS. 4*a-c* show examples of a shaping the slot between the antenna elements in the antenna component according to the invention. The antenna component is seen from above without a possible support plate in each of the three drawings. The substrate belonging to the component is rectangular seen from above, thus having parallel ends and parallel longer sides. In FIG. 4*a* the slot 460*a* between the antenna elements on the upper surface of the substrate 410*a* is straight and travels diagonally on the upper surface of the substrate in respect of the direction of its ends. In FIG. 4*b* the slot 460*b* between the antenna elements has turns. The turns are rectangular and the number of them is ten so that two finger-like strips 421 and 422 are formed in the first antenna element 420*b*, extending between the areas belonging to the second antenna element 430*b*. In addition, a third similar strip is formed at an outer edge of the area formed by the antenna elements. Symmetrically, two finger-like strips 431 and 432 are formed in the second antenna element, extending between the areas belonging to the first antenna element. In addition, a third similar strip is formed at another outer edge of the area formed by the antenna elements. In FIG. 4*c* the slot 460*c* between the antenna elements is straight and travels crosswise on the upper surface of the substrate in the direction of its ends. In addition, in the example of FIG. 4*c* the antenna elements have different sizes; the first element 420*c* is smaller than the second element 430*c*.

In FIG. 4*b* the slot between the antenna elements is considerably longer and also narrower than in FIGS. 4*a* and 4*c*. For these reasons the operating band of an antenna corresponding to FIG. 4*b* lies in a clearly lower range than the operating band of an antenna corresponding to FIG. 4*a* and especially to FIG. 4*c*. By shaping the antenna elements again for example so that a diagonal slot like the slot 460*a* is replaced with a devious slot like the slot 460*b*, which is some narrower at the same time, the antenna operating band can be shifted e.g. from the range of 1.8 GHz to the range of 900 MHz without to change the structure otherwise. The number of the turns in the slot between the antenna elements can naturally vary as well as the lengths of the strips formed by the turns.

Figure 5:
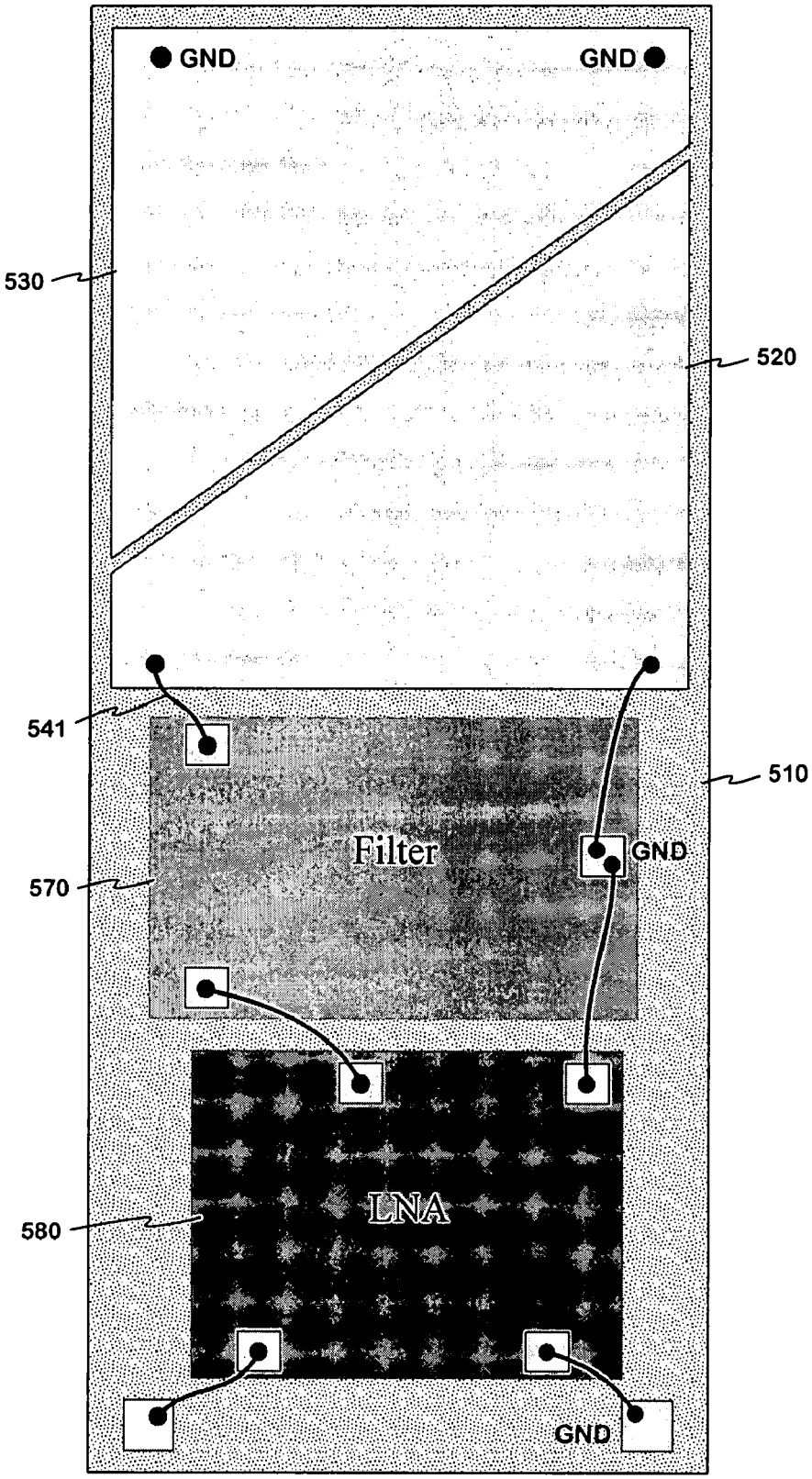
FIG. 5 presents a third example of an antenna component according to the invention.

FIG. 5 shows a third example of an antenna component according to the invention, seen from above. On the upper surface of the substrate 510 there are now in addition to the antenna elements 520 and 530 an antenna filter 570 and the low noise pre-amplifier 580 (LNA) of a radio receiver. The filter 570 is for example of the FBAR type (Film Bulk Acoustic Resonator). The filter and the amplifier, as well as the inductive and capacitive parts required by the amplifier matching have been made on the surface of the substrate in the same process as also the antenna elements. In the example of FIG. 5 the antenna elements, filter and amplifier have been first processed as separate and then connected to each other by wiring. The connecting wiring could also be replaced by conductors processed on the surface of the substrate. Because the component at issue is a part of a receiver, the conductor 541, connecting the first antenna element 520 to the filter input, is now not the feed conductor of the antenna, of course, but the receive conductor. In this description and the claims the term "feed conductor" covers for simplicity also such receive conductors. Naturally one and the same conductor is often for both the transmitting and the receiving.

In addition to the saving of space, the above described integrated structure has the advantage that there is no need to use a standard impedance level, such as 50Ω, at the antenna end of the receiver, but the impedance level can be chosen according to the optimum performance.

Figure 6:
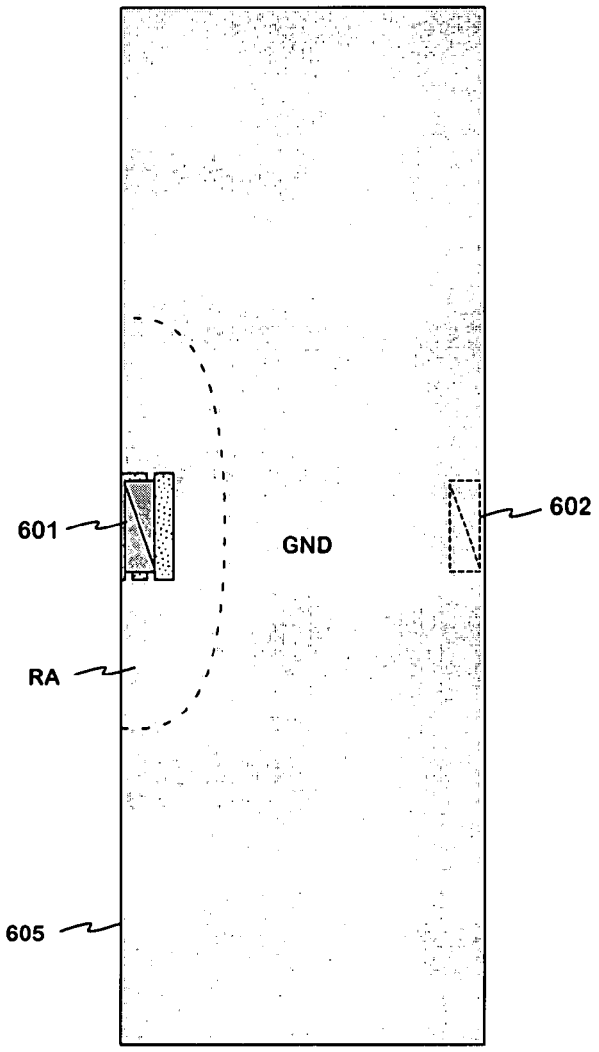
FIG. 6 presents an application of an antenna component according to the invention.

FIG. 6 shows an application of an antenna component according to the invention. Therein an antenna component 601 has been placed to the middle of one long side of the radio device circuit board 605, in the direction of the circuit board. The antenna component is now designed so that when it is fed, an oscillation is excited in the ground plane GND, the frequency of the oscillation being the same as the one of the feeding signal. In that case also the ground plane functions as a useful radiator. A certain area RA round the antenna component radiates to significant degree. The antenna structure can comprise also several antenna components, as the component 602 drawn with dashed line in the figure.

Figure 7:
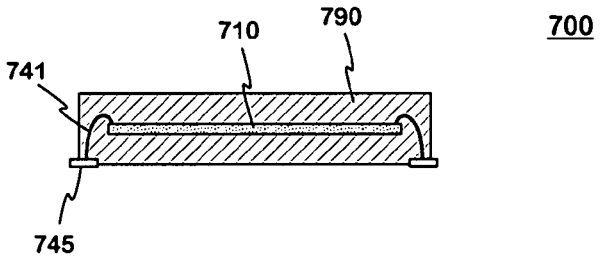
FIG. 7 presents a fourth example of an antenna component according to the invention.
Figure 8:
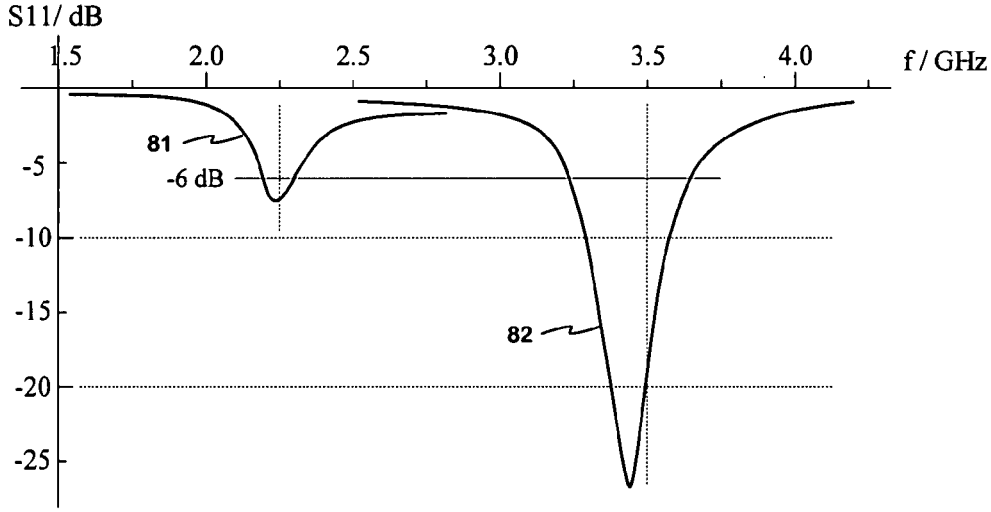
FIG. 8 shows examples of the matching of antennas according to the invention.

FIG. 7 shows a fourth example of an antenna component according to the invention as a longitudinal section. The antenna component 700 comprises now a plastic protective part 790, within the mass of which the substrate 710 with the antenna elements is entirely located. At the same time the protective part supports the substrate. On the lower surface of the protective and support part 790 there are a sufficient number of connection pads functioning as contacts, such as connection pad 745, to which a coupling conductor 741 of the antenna element has been connected within the component FIG. 8 shows two examples of the matching of the antennas according to the invention. It presents a curve of the reflection coefficient S11 as a function of frequency. The curve 81 has been measured from an antenna made by a component according to FIG. 4*a*, the size of the substrate being 1.22·2.5 $mm^2$ and the slot width being 80 μm. The substrate is of Gallium-Arsenide. The operating band of the antenna lies in the range of the Bluetooth system. If the criterion for the boundary frequency is used the value −6 dB of the reflection coefficient, the bandwidth becomes about 100 MHz. In the center of the operating band the reflection coefficient is −7.4 dB. The curve 82 has been measured from an antenna made by a component according to FIG. 4*b*, the substrate being similar as before. The center frequency of the antenna is about 3.44 GHz and the bandwidth is about 440 MHz, if the criterion for the boundary frequency is used the value −6 dB of the reflection coefficient. In the center of the operating band the reflection coefficient is −26 dB.

Figure 9:
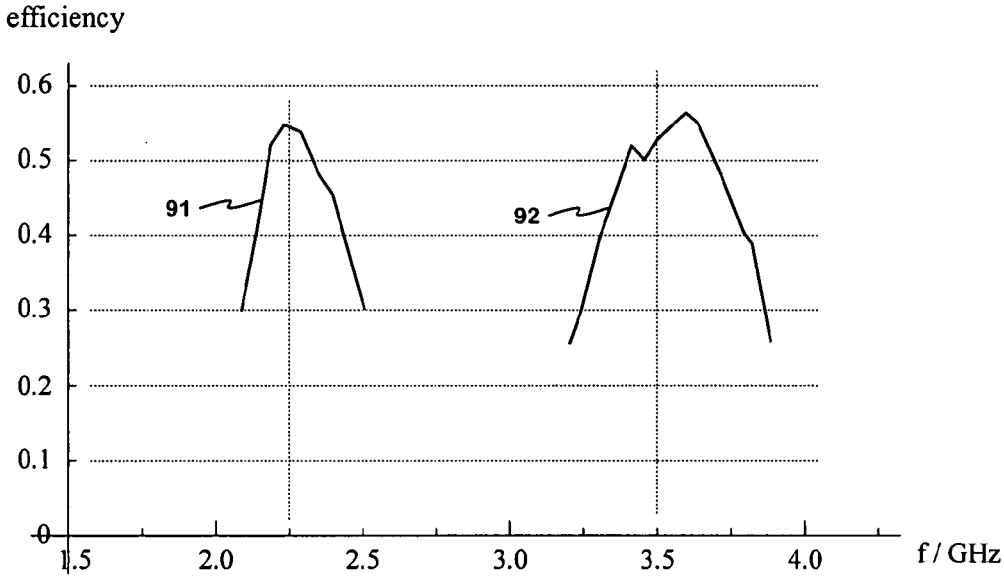
FIG. 9 presents examples of the efficiency of antennas according to the invention.

FIG. 9 shows two examples of the efficiency of the antennas according to the invention. The efficiency curve 91 has been measured from the same antenna as the reflection coefficient curve 81 in FIG. 8, and the efficiency curve 92 has been measured from the same antenna as the reflection coefficient curve 82. In the operating bands of the antennas the efficiency is about 0.5 or a little better. The efficiency is considerably high taking into account that it is the case of an antenna using a dielectric substrate.

In this description and the claims, the qualifiers "lower", "upper" and "from above" refer to the position of the antenna component shown in FIGS. 2 and 3. The use position of the antenna can naturally be any.

An antenna component and antenna according to the invention has been described above. Their structural parts can naturally differ from those presented in their details. For example, the shape of the antenna elements can vary largely. They can be symmetrical in a different way or asymmetric also in another way than what is presented in FIG. 4*c*. The inventive idea can be applied in different ways within the scope set by the independent claim 1.

The invention claimed is:

1. An antenna component, comprising:

a dielectric substrate having an upper surface and a first thickness, a conductive coating deposited on the upper surface and forming a first portion and a second portion, the upper surface comprising an area free from the conductive coating and substantially enveloping the first and the second portions, the first portion configured to be electrically coupled to a feed structure at a first location and to a ground plane at a second location, the first and the second locations disposed proximate a first edge of the upper surface; and an electromagnetic coupling element disposed substantially between the first portion and the second portion, the coupling element configured to electromagnetically couple the second portion to the feed structure, the second portion further configured to be electrically coupled to the ground plane at a third location disposed proximate a second edge of the upper surface;

wherein said first and second edges are disposed substantially at opposite ends of the dielectric substrate; and wherein:

the upper surface is characterized by third and fourth edges each configured substantially perpendicular to at least one of said first edge and said second edge;

said first edge and said third edge forming a first corner, said first edge and said fourth edge forming a second corner, said second edge and said third edge forming a third corner;

said first location is disposed adjacent said first corner so that said first location is substantially equidistant from each of said first edge and said third edge;

said second location is disposed adjacent said second corner so that said second location is substantially equidistant from each of said second edge and said third edge; and said third location is disposed adjacent said third corner so that said third location is substantially equidistant from each of said first edge and said fourth edge.

2. The antenna component of claim 1, wherein the first and the second portions comprise a convex polygon shape.

3. The antenna component of claim 2, wherein the polygon comprises a right-angled triangle, and the coupling element is configured to separate a hypotenuse of the first portion from a hypotenuse of the second portion.

4. The antenna component of claim 1, wherein the coupling element comprises a linear slot disposed substantially diagonally on the upper surface.

5. The antenna component of claim 1, wherein the second portion is configured to be electrically coupled to the ground plane at a fourth location.

6. The antenna component of claim 5, wherein the first, the second, the third, and the fourth locations are electrically coupled to a support plate via electrical conductors disposed substantially external to said dielectric substrate.

7. The antenna component of claim 5, wherein the first, the second, the third, and the fourth locations are disposed substantially proximate first, second, third and fourth corner regions on the upper surface, respectively.

8. The antenna component of claim 1, wherein the coupling element comprises a slot comprised of at least one turn.

9. The antenna component of claim 1, wherein the ground plane is configured a predetermined distance away from the first and the second portions along at least a portion of a first edge and along at least a portion of a second edge of the dielectric substrate.

10. The antenna component of claim 1, wherein the second and the third locations are disposed distally relative to the electromagnetic coupling element.

11. An antenna component, comprising:

a dielectric substrate having an upper surface, the upper surface having a conductive coating, the conductive coating forming a first portion and a second portion, the upper surface comprising an area free from the conductive coating and substantially enveloping the first portion and the second portion, the first portion configured to be coupled to a feed structure at a first location and to a ground plane at a second location, the second portion configured to be coupled to the ground plane at third and fourth locations; and an electromagnetic coupling element disposed substantially between the first portion and the second portion, the coupling element configured to electromagnetically couple the second portion to the feed structure;

wherein:

the second and the third locations are positioned distally relative to the electromagnetic coupling element; and the upper surface comprises a first edge configured substantially perpendicular to said electromagnetic coupling element, and a second edge configured substantially perpendicular to said electromagnetic coupling element, said first edge and said second edge being disposed substantially at opposite ends of the dielectric substrate;

said first and said second location are disposed adjacent said first edge; and said third and said fourth location are disposed adjacent said second edge; and wherein:

the upper surface further comprises:

a third edge configured substantially perpendicular to at least one of said first edge and said second edge; and a fourth edge configured substantially perpendicular to at least one of said first edge and said second edge;

said first edge and said third edge forming a first corner, said first edge and said fourth edge forming a second corner, said second edge and said third edge forming a third corner;

said first location is disposed adjacent said first corner so that said first location is substantially equidistant from each of said first edge and said third edge;

said second location is disposed adjacent said second corner so that said second location is substantially equidistant from each of said second edge and said third edge; and said third location is disposed adjacent said third corner so that said third location is substantially equidistant from each of said first edge and said fourth edge.

12. The antenna component of claim 11, wherein the first, second, third, and fourth locations are disposed substantially proximate to first, second, third and fourth corners of the dielectric substrate, respectively.

13. Antenna apparatus comprising:

an antenna component comprising:

a dielectric substrate having an upper surface;

a first portion and a second portion disposed on the upper surface; and an electromagnetic coupling element disposed substantially between the first portion and the second portion; and a dielectric support configured to receive the dielectric substrate, the support having a feed point adapted to couple to an antenna feed, and at least a first short circuit point (SP) and a second short circuit point (SP) each adapted to couple to a ground plane, the support comprising an area of a first predetermined width and being free from any conductive coating along at least a portion of a first edge of the dielectric substrate;

wherein the first portion is configured to couple to the feed point via a first coupling point and first conductor, and to the first SP via a second coupling point and second conductor, and the second portion is configured to couple to the second SP via a third coupling point and third conductor, each of the first, second and third conductors disposed at least partly external to the dielectric substrate; and wherein:

the first and second coupling points are disposed substantially in first and second corners of the first portion, respectively;

the third coupling point is disposed substantially within a corner of the second portion; and each of the first and second coupling points, and the third coupling point, is disposed substantially equidistant from edges forming said first and second corners of said first portion, and said corner of said second portion, respectively.

14. The antenna of claim 13, wherein the support is adapted to be attached to a printed circuit board (PCB), the PCB comprising at least a portion of the ground plane and at least a portion of the antenna feed.

15. The antenna of claim 14, wherein said PCB further comprises a ground conductor, said ground conductor having an adjustable dimension, the adjustable dimension configured for tuning the antenna.

16. The antenna of claim 14, wherein the ground plane is arranged a first predetermined distance away from the dielectric substrate along at least a portion of a first edge of the support.

17. The antenna of claim 16, wherein the ground plane is arranged a second predetermined distance away from the dielectric substrate along at least a portion of at least one of a second or a third edge of the support, said at least one of a second or a third edge being non-coplanar with said first edge.

18. The antenna of claim 13, wherein said area is free from conductive coating along at least a portion of a second edge of the dielectric substrate.

19. The antenna of claim 13, wherein the antenna component further comprises:

an antenna filter disposed on the upper surface and electrically coupled to the first portion at first and second locations; and a low-noise amplifier disposed on the upper surface and electrically coupled to said antenna filter.

20. The antenna of claim 19, wherein said antenna filter comprises a film bulk acoustic resonator electrically coupled to the first and the second locations by conductors disposed on the upper surface.

21. Antenna apparatus comprising:

an antenna component comprising:

a dielectric substrate having an upper surface;

a first portion and a second portion disposed on the upper surface; and an electromagnetic coupling element disposed substantially between the first portion and the second portion; and a dielectric support configured to receive the dielectric substrate, the support having a feed point adapted to couple to an antenna feed, and at least a first short circuit point (SP) and a second short circuit point (SP) each adapted to couple to a ground plane;

wherein:

the support is adapted to be attached to a printed circuit board (PCB), the PCB comprising at least a portion of the ground plane and at least a portion of the antenna feed;

the first SP and the second SP each are positioned distally relative to the electromagnetic coupling element; and wherein:

the feed point and first SP, and the second SP, are each electrically coupled to respective first, second and third coupling points;

the first and second coupling points are disposed substantially in first and second corners of the first portion, respectively;

the third coupling point is disposed substantially within a corner of the second portion; and each of the first and second coupling points, and the third coupling point, is disposed substantially equidistant from edges forming said first and second corners of said first portion, and said corner of said second portion, respectively.

22. The antenna of claim 21, wherein:

the support further comprises a third SP; and the second portion is further configured to couple to the third SP via a first detachable electrical conductor disposed substantially external to the dielectric substrate.

23. The antenna of claim 21, wherein:

the first portion is configured to couple to the feed point and the first SP via a second and a third detachable electrical conductor disposed substantially external to the dielectric substrate; and the second portion is configured to couple to the second SP via a fourth detachable electrical conductor disposed substantially external to the dielectric substrate.

24. The antenna of claim 21, wherein the support comprises an area of a first predetermined width, the area being free from any conductive coating along at least a portion of a first edge of the dielectric substrate.

* * * * *